US010208746B2

(12) United States Patent
Wilkens et al.

(10) Patent No.: US 10,208,746 B2
(45) **Date of Patent: *Feb. 19, 2019**

(54) SYSTEM AND METHOD FOR MULTI-COMPONENT MIXTURE CONTROL

(71) Applicant: EPIC Solutions, Inc., Fargo, ND (US)

(72) Inventors: Jeffrey Arnold Wilkens, West Fargo, ND (US); Timothy John Marthe, Relies Acres, ND (US); Justin D. Almen, West Fargo, ND (US)

(73) Assignee: EPIC SOLUTIONS, INC., Fargo, ND (US)

( * ) Notice: Subject to any disclaimer, the term of this patent is extended or adjusted under 35 U.S.C. 154(b) by 103 days.

This patent is subject to a terminal disclaimer.

(21) Appl. No.: 15/617,211

(22) Filed: Jun. 8, 2017

(65) Prior Publication Data

US 2017/0268501 A1 Sep. 21, 2017

Related U.S. Application Data

(63) Continuation of application No. 14/227,151, filed on Mar. 27, 2014, now Pat. No. 9,726,168.

(60) Provisional application No. 61/806,708, filed on Mar. 29, 2013.

(51) Int. Cl.
*F04B 49/20* (2006.01)
*F04B 23/04* (2006.01)

(52) U.S. Cl.
CPC ..... *F04B 49/20* (2013.01); *F04B 23/04* (2013.01); *Y10T 137/2564* (2015.04); *Y10T 137/86163* (2015.04)

(58) Field of Classification Search
CPC ..... F04B 2203/0209; F04B 41/06; F04B 49/065; Y10T 137/2529; Y10T 137/2564; Y10T 137/86027; Y10T 137/86163
USPC ..... 324/164; 417/2; 700/282
See application file for complete search history.

(56) References Cited

U.S. PATENT DOCUMENTS

| | | | |
|---|---|---|---|
| 4,493,286 | A | 1/1985 | Carson |
| 4,538,222 | A | 8/1985 | Crain et al. |
| 4,928,880 | A | 5/1990 | Prus et al. |
| 5,232,052 | A | 8/1993 | Arvidson et al. |
| 5,388,761 | A | 2/1995 | Langeman |
| 2011/0101969 | A1 | 5/2011 | Gualtieri et al. |

*Primary Examiner* — R. K. Arundale
(74) *Attorney, Agent, or Firm* — Marsh Fischmann & Breyfogle LLP; Russell T. Manning

(57) ABSTRACT

A system for controlling the mixing ratio of a multi-component mixture including a first pump connectable to a source of a first component and a second pump connectable to a source of a second component. The first and second pump being associated with at least one linear sensor for generating an output indicative of actual pump speed or shaft displacement of the pump. The system further includes a control circuit operative to utilize the output of the linear sensor of one of the pumps to generate a control signal for controlling the output of the other pump.

20 Claims, 5 Drawing Sheets

SYSTEM AND METHOD FOR MULTI-COMPONENT MIXTURE CONTROL

CROSS REFERENCE

This application is a continuation application of U.S. Non-Provisional application Ser. No. 14/227,151, filed Mar. 27, 2014, and claims the benefit of U.S. Provisional Application No. 61/806,708, filed Mar. 29, 2013, the entire contents of these applications are incorporated by reference in their entirety as though set forth herein.

FIELD

The present invention relates to mixture control of multi-component mixtures, primarily for spray-on applications. In one specific application, the invention relates to controlling a mixing ratio of a multi-component mixture for roadway markings.

BACKGROUND

This section is intended to introduce the reader to various aspects of art that may be related to aspects of the presented inventions which are described and/or claimed below. This section is believed to be helpful in providing the reader with background information to help understand the various aspects of the present invention. Accordingly, it should be understood that the statements in this section are to be read in this light, and not as admissions of prior art.

In a number of applications where materials are sprayed onto a surface, two or more components are mixed immediately prior to their application to the surface. In these applications, the components typically begin reacting upon their combination in a mixing line or mixing chamber and cure once applied to a surface. Such 'multi-component' mixtures are utilized for varying applications. In many of these multi-component applications, precise control of the mixing ratio of the individual components is important to provide a final product having desired qualities.

One exemplary application where controlling the mixing ratio of a multi-component mixture is important is the roadway-marking industry. In this application, incorrect ratios of material components adversely affect the set times and durability of the final roadway-marking lines. Such inferior lines have a reduced life span and fade over time. Manual roadway-marking mixture control systems currently exist to help control the ratio of multi-component mixtures. However, manual methods without real time feedback typically fail to provide timely and accurate data regarding actual flow output rates and, hence, mixing ratios of pumps supplying individual components to a mixing line/chamber—leading to inconsistent marking lines. Moreover, typical control systems are manually adjusted based on pump speed setting alone rather than actual flow rates and pump output.

Often, pump speed settings are not an accurate representation of flow. Independent of pump speed settings, the actual flow output rates from the pumps that affect mixing ratios may vary due to changes in temperature, pressure, and viscosity of the components. That is, manual systems that set mixing ratios by merely increasing and decreasing pump speeds without accounting for actual output flow rates of the component supply pumps generally fail to provide consistent mixing ratios as the temperature, pressure, and viscosity of the mixing materials change over time. In addition, existing systems typically change mixing ratios by only altering the pump speed of a secondary component pump—not accounting for actual flow changes in primary component pumps. In the case of hydraulically controlled pumps, the pump speed of primary and secondary pumps are controlled by adjusting hydraulic pressure to the pumps. However, such hydraulic pressure is not directly related to material flow change due to the nature of hydraulics. Accordingly, there is a need for a control system that can automatically and timely adjust mixing ratios based on accurate flow rates and pump speeds to provide consistent final products.

SUMMARY

The details of one or more aspects of the invention are set forth in the below summary. Other features, objects, and advantages of the invention will be apparent from the detailed description, drawings, and claims.

The disclosed systems and methods (i.e., utilities) allow for accurately monitoring and efficiently adjusting mixing ratios in a multi-component application apparatus. In a two-component apparatus, the utilities control a mixing ratio through control of one pump that supplies one component to a mixing chamber or line based on the actual velocity of another pump that supplies another component to the mixing chamber/line. The disclosed utilities include various electrical and/or mechanical components including a control circuit having a programmable-logic controller (PLC), one or more sensors for monitoring the pumps and a flow control valve that throttles the flow of a hydraulic actuating fluid to one or both of the pumps.

The sensors may be utilized to monitor the position of the pumps from which an actual velocity and/or output of the pumps may be calculated. That is, the outputs of the sensors may be utilized to calculate the current or actual (e.g., instantaneous) velocity of the pumps. Stated otherwise, the instantaneous velocities of the pumps may be sampled. In one arrangement, the first and/or second pumps may be associated with at least one linear sensor for generating an output indicative of pump shaft location. The pump shaft location may be utilized with one or more prior pump shaft locations to calculate pump velocity. The pump velocity may also be utilized with known pump displacement to calculate flow outputs of the pumps.

The control circuit is operative to utilize the output of the sensors to generate a control signal for controlling the velocity of one of the pumps. For instance, the control circuit may utilize information from the sensors over a predetermined window to calculate an absolute velocity of each of the pumps. The control circuit may further implement a feedback equation to determine a velocity adjustment/control value or signal for use in adjusting the velocity of one of the pumps based on the velocity of the other pump. In one arrangement, the feedback equation is a proportional-integral-derivative (PID) equation having a set point derived from the absolute velocity of the first pump and a feedback variable associated with the absolute velocity of the second pump. In a further arrangement, the set point is a scaled value of the absolute velocity of the first pump, where the first pump velocity is scaled to a user set mixing ratio. The error output of the PID equation is utilized to generate the velocity adjustment signal.

In one arrangement, the velocity adjustment signal is a pulse-width-modulation (PWM) signal. In such an arrangement, the duty cycle of the PWM signal is set based on an output of a feedback equation having inputs representing the actual velocities of the first and second pumps. In this arrangement, the flow control valve, which regulates/throttles hydraulic actuating fluid to the controlled pump, is controlled with the PWM signal. More specifically, a coil, which activates and deactivates in response to the duty cycle of the PWM signal module, opens and closes flow through the flow control valve to adjust the speed of the controlled pump. In one embodiment, the programmable-logic (PLC) controller sets the duty cycle of the PWM signal. In another embodiment, the PLC wirelessly transmits information for use in setting the duty cycle of the PWM signal and a secondary controller or microprocessor in electrical communication with the coil generates the PWM signal In another aspect, the system for controlling the mixing ratio of a multi-component mixture may include a lead or first pump for supplying a first mixing material to a mixing line and a second pump for supplying a second mixing material to the mixing line. In one non-limiting embodiment, the first mixing material may comprise Methylmethacrylate (MMA) and the second mixing material may comprise Dibenzoyl Peroxide (BPO). The system may also include at least one linear sensor for generating an output indicative of the velocity or velocities of the pumps and the output flows of the first mixing material and the second mixing material. The linear sensors may be non-contact magnetic inductive linear sensors associated with each pump. In such an aspect, the system may include a control circuit that utilizes the output of the at least one linear sensor to generate a control signal for controlling the flow output of the second pump. The control circuit may control the speed of the second pump to maintain a ratio of the first mixing material to the second material in the mixing line. In one exemplary embodiment, the control circuit maintains a ratio of about 98% first mixing material and about 2% second mixing material. However it will be appreciated that the mix ratio can be different for different brands of materials and/or different temperatures. The control circuit may average pump-velocity readings from the linear sensor over a predetermined window to calculate an absolute velocity of the first pump and implement a feedback equation. As with other aspects, the set point of the equation may be derived from the absolute velocity of the first pump and a feedback variable may be the absolute velocity of the second pump. An error output of the equation may be used to generate the control signal.

The above summary of some example aspects is not intended to describe each disclosed embodiment or every implementation of the invention.

BRIEF DESCRIPTION OF THE DRAWINGS

For a more complete understanding of the present disclosure and further advantages thereof, reference is now made to the following detailed description taken in conjunction with the drawings in which.

Figure 1:
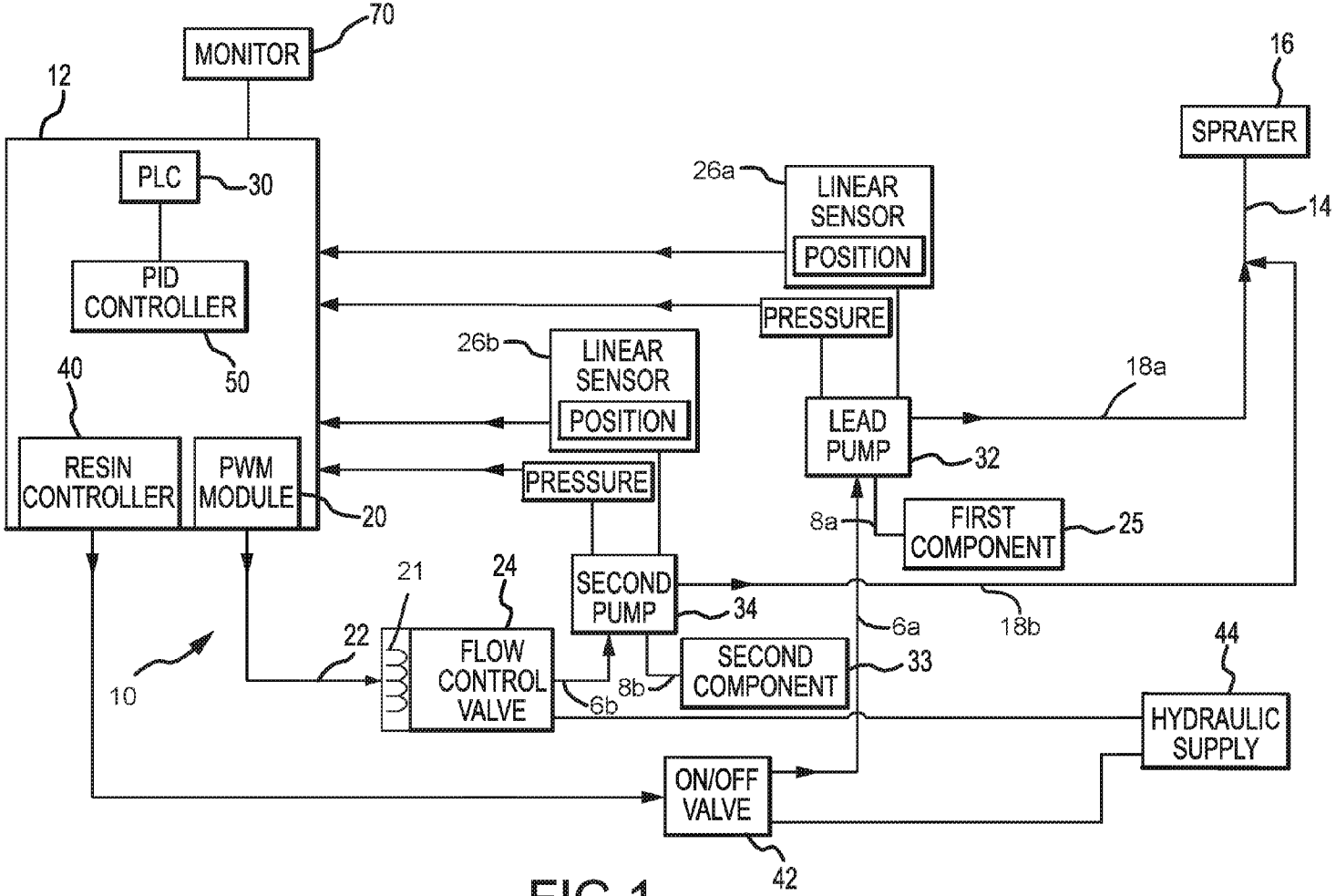
FIG. 1 illustrates a multi-component mixture control system.

While the invention is susceptible to various modifications and alternative forms, specifics have been shown by way of example in the drawings and will be described in detail below. It should be understood that the intention of the detailed description is not to limit aspects of the invention to the particular embodiments described. On the contrary, the invention covers all modifications, equivalents, and alternatives falling within the spirit and scope of the invention.

DETAILED DESCRIPTION

The following defined terms disclosed in this detailed description shall apply, unless a different definition is given in the claims or elsewhere in this specification. As used in this specification and the appended claims, the singular forms "a," "an," and "the" include the plural referents unless the content clearly dictates otherwise. As used in this specification and the claims, the term "or" is generally employed in its sense including "and/or" unless the content clearly dictates otherwise.

The accompanying drawings assist in illustrating the various pertinent features of the presented inventions. Though discussed primarily in relation to a multi-component mixture control system for use in controlling the mixture of Methylmethacrylate (MMA) and Dibenzoyl Peroxide (BPO) for roadway markings, it will be appreciated that the presented inventions are not so limited. For example, the presented systems and methods may apply to other systems used for applying multi-component materials such as gelcoats, polyesters, and fast setting materials such as foam insulation. The following description is presented for purposes of illustration and description. Furthermore, the description is not intended to limit the disclosed embodiments of the inventions to the disclosed forms. Consequently, variations and modifications commensurate with the following teachings, and skill and knowledge of the relevant art, are within the scope of the presented inventions.

In a multi-component application apparatus such as a sprayer, two or more components are supplied to a mixing line/chamber of the apparatus via separate supply sources. For example, the components supplied to a sprayer for roadway-marking application generally comprise MMA and BPO. MMA acts as a resin and BPO acts a hardener in order to start the polymerization process of the MMA resin. The ratio of MMA to BPO, in some embodiments, requires precise control to ensure desired material properties will set properly. In one embodiment utilized for roadway markings, a rate of about 98% MMA to about 2% BPO is desirable. Other ratios are possible. Often, one or all of the mixing components (including MMA and BPO) are supplied under pressure. Further one or both of the components may be preheated. The components are combined in the mixing line/chamber and expelled under pressure (e.g., fluid pressure and/or air pressure) via a nozzle before the components set. Aspects of the presented disclosure are applicable to roadway applications as well as other applications where precise control of a mixing ratio is desired.

Figure 2:
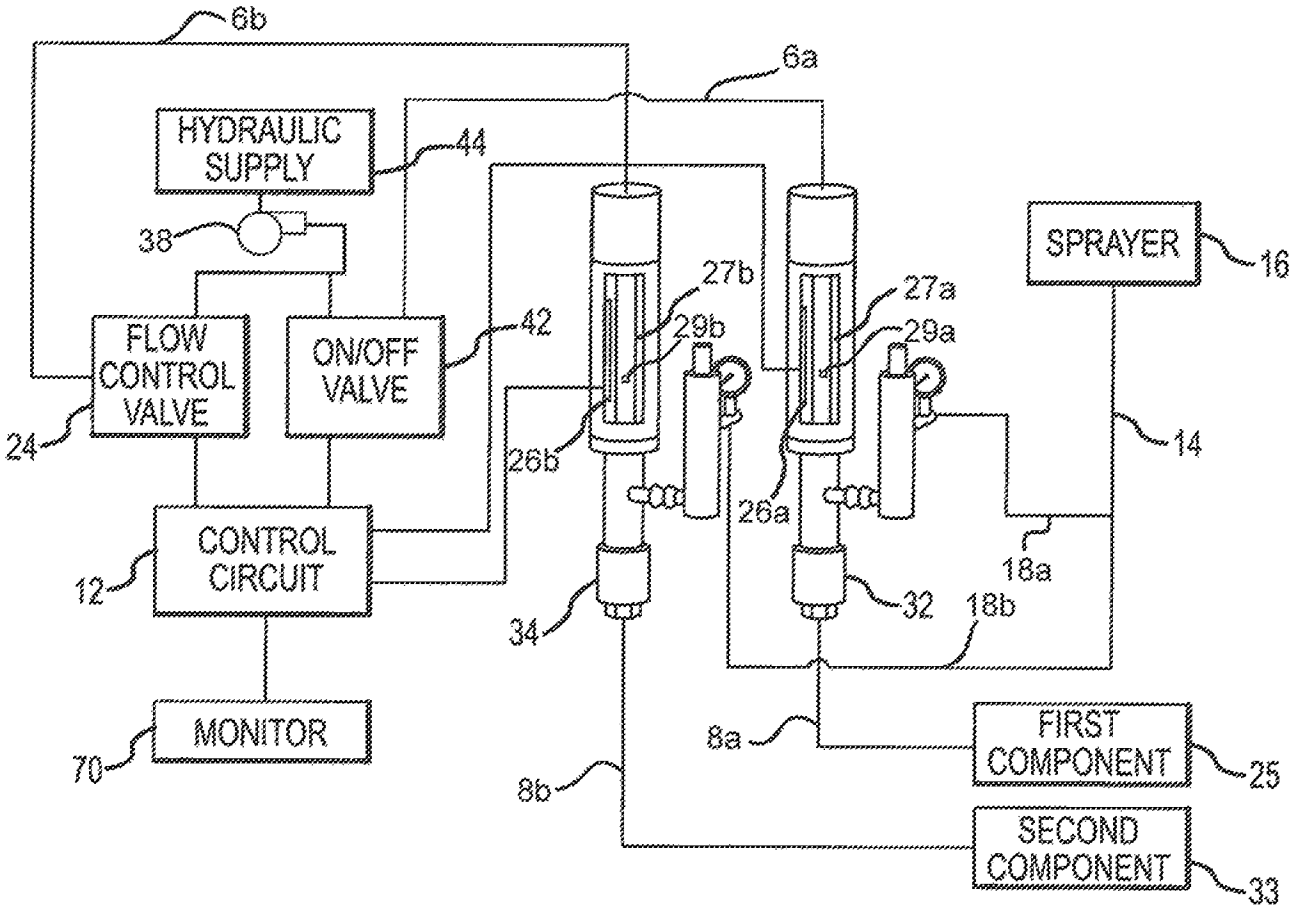
FIG. 2 illustrates another multi-component mixture control system.

FIGS. 1 and 2 illustrate an exemplary multi-component application apparatus. As shown, the apparatus has a first pump 32 fluidly connected to a first component source/reservoir 25 via a first fluid inlet line 8*a*. In operation, the first pump 32 draws the first component from the first reservoir and expels the first component out via a first fluid outlet line 18*a*. A second pump is fluidly connected to a second component source/reservoir 33 via a second fluid inlet line 8*b*. The second pump draws the second component from the second reservoir and expels the second component out via a second fluid outlet line 18*b*. The outlet lines 18*a*, 18*b* are fluidly coupled at a junction that forms a mixing line or mixing chamber 14 where the two components are combined. The mixed components are then output via a sprayer/nozzle 16.

In the illustrated embodiment, the first and second pumps 32, 34 are hydraulically actuated positive displacement pumps. Accordingly, the pumps 32, 34 are connected to a supply of pressurized hydraulic fluid (i.e., hydraulic supply 44) supplied by a supply pump 38 (not shown in FIG. 1) via hydraulic supply lines 6*a*, 6*b*. Hydraulic return lines between the pumps and hydraulic supply are not shown for purposes of clarity. In operation, a separate hydraulic supply pump (not shown) circulates hydraulic fluid through the first and second pumps 32, 34 resulting in the shafts 27*a* and 27*b* of each of the pumps 32, 34 reciprocating and thereby drawing in their respective component on one stroke (e.g., retraction stroke) and discharging that component under pressure on another stroke (e.g., forward stroke).

The known displacement (e.g., pump cylinder volume) of each of the pumps 32, 34 and their user settable operating speed dictate the output of the pumps. Accordingly, a mixture ratio of the two components is set by operating the two pumps at different speeds to achieve a final product having desired component proportions/ratios. However, the present inventors have recognized that pump speed alone is not an accurate representation of flow output rate of the pumps. That is, simply setting a pump to a certain speed does not necessarily result in an anticipated output. The actual flow output rates from the pumps, which affect mixing ratios, may vary due to changes in temperature, pressure and/or viscosity of the mixing components. In addition, different batches of components from the same or different manufactures may have variations in consistency that affect flow output rates. For example, components with heavier fillers may increase viscosity and affect actual flow output rates while pump speed settings are identical. Stated otherwise, numerous factors can result in alteration of pump output and/or speed. Accordingly, such alteration in the operation of the pump can result in a final product having an incorrect mixing ratio, which may affect the quality of the product as applied. Systems that set mixing ratios by merely increasing and decreasing pump speed settings without accounting for actual pump speeds/velocities generally fail to provide consistent mixing ratios as mixing component variables change over time.

In order to determine the actual speed/velocity of the pumps 32, 34, the presented system monitors the actual position of the pump shafts 27*a*, 27*b* (hereafter '27' unless specifically referenced). That is, it has been recognized that by monitoring the movement of the pump shafts 27 the actual or absolute pump velocities and flow outputs can be precisely determined. This actual pump speed in conjunction with the known displacement of the pump may be utilized to precisely calculate an actual output flow of the pump. In the illustrated embodiment, non-contact magnetic inductive linear sensors 26*a*, 26*b* (hereafter '26' unless specifically referenced) are utilized to sense the location of magnetic targets 29*a*, 29*b* (hereafter '27' unless specifically referenced) mounted directly to the shafts 27*a*, 27*b* of the pumps 32, 34. The sensors 26 output an indication of the absolute location of the pump shafts 27 to a control circuit 12, which uses the output to calculate the velocity of each of the pumps, as further discussed below. In the present embodiment, the sensors 26 generate an analog voltage level, e.g., between 0 volts and 5 volts, that is indicative of the shaft position. One exemplary linear position sensor is commercially available from Turck Inc., of Plymouth Minn.

The ability to calculate the actual velocity of each pump in a multi-component mixture system permits precisely controlling pump speeds and flow outputs, which allows for precisely controlling mixing ratios. In this regard, aspects of the presented inventions are directed to a feedback control system that continuously monitors the actual speed or position of a first pump (e.g., resin pump 32) to continuously control the speed or position of at least a second pump (e.g., hardener pump 34). That is, the feedback control system allows for continuously adjusting the velocity of the second pump 34 based on the velocity of the first pump 32 to maintain a desired mixing ratio.

As shown in FIGS. 1 and 2, a multi-component mixture (MCM) control system 10 is provided that allows precise mixture ratio control of multiple components 25, 33, such as MMA and BPO, based on the actual velocities of the pumps 32, 34 supplying these components. The MCM control system 10 includes a control circuit 12 having programmable-logic (PLC) controller 30 and a hydraulic flow control valve 24, which throttles the speed of the second pump 34. Specifically, the PLC produces a velocity adjustment or flow control signal 22 for the control valve 24, which controls the flow of hydraulic fluid from the hydraulic supply 44 to the second pump 34. The controlled flow through the flow control valve 24 adjusts the operating speed of the second pump 34 to control pump flow output, based on the absolute speed and, hence, actual flow output of the first pump 32 (e.g., lead pump).

As illustrated in FIGS. 1 and 2, the PLC controller 30 uses the non-contact magnetic inductive linear sensors 26*a*, 26*b* to sense the location of the magnetic targets 29*a*, 29*b* mounted directly to the shafts 27*a*, 27*b* of the pumps 32, 34. The PLC 30 samples the output of the sensors 26*a* and 26*b* as an analog voltage level, e.g., between 0 volts and 5 volts, which is indicative of the current position of the shafts 27*a* and 27*b*. The PLC controller 30 may periodically sample these analog signals (e.g., at a rate of 4 hertz).

The velocity of each pump 32, 34 is derived by the PLC controller 30 by taking a current sample and subtracting the value of a previous sample. The absolute value of this number is taken to represent an actual pump velocity. To account for noise in the system and velocity offsets that occur when the pumps switch direction (e.g., reciprocate) the velocity of each pump may be averaged over a time window (e.g., a period of 2.0 seconds) before being fed into a feedback loop, as discussed below. It will be appreciated that the sampling rate and time window for averaging may be varied for a specific application and/or based on physical specifications (e.g., pump displacements, etc.) of a specific multi-component mixture control system.

To generate the flow control signal 22 to control the operation of the flow control valve 24 and the velocity of the second pump 34, the PLC controller 30 employs a feedback equation. In the illustrated embodiment, the feedback equation is provided by a proportional-integral-derivative (PID) controller 50 (e.g., a control loop feedback mechanism). The PID controller 50 utilizes the velocity values calculated by the PLC as input values to generate an adjustment to the speed of the second pump 34 to maintain a desired mixing ratio. More specifically, the PID controller 50 implements a continuous differential feedback equation that calculates an error value as the difference between a measured variable (e.g., second pump speed) and a desired set point. The set point of the equation is derived from the absolute velocity of the lead pump 32 which is determined using the linear sensor 26*a*. More specifically, in the present embodiment, the set point is the absolute velocity of the lead pump as scaled to a mixing ratio set by an operator. For instance, an operator may set a desired mixing ratio via a user interface or monitor 70. A feedback variable for the equation is the absolute velocity of the second pump 34. The error term of the equation is determined by subtracting the absolute velocity of the second pump 34 from the set point (e.g., scaled velocity of the first pump). Once the data related to the velocity of the first pump 32 and second pump is provided, PID controller 50 calculates the appropriate adjustment (i.e., for adjusting the velocity of the second pump 34) to minimize the error and thereby maintain the correct pump velocities to maintain a desired mixing ratio of the components in mixing line 14.

After calculating the appropriate adjustments, PID controller 50 sends information to the PLC controller 30 which generates the flow control signal 22. In the illustrated embodiment, the flow control signal 22 applies energy to a coil 21 that opens and closes ports in the flow control valve 24, which allows fluid flow from the hydraulic supply 44 to pass through the second pump 34. In the illustrated embodiment, the flow control valve 24 is a three-port hydraulic device. The hydraulic flow between two of the ports is controlled the coil 21, which is activated and deactivated in response to the flow control signal 22. When activated, the coil 21 energizes an electromagnet (not shown), which opens a hydraulic flow path through the flow control valve 24. When deactivated, the coil and electromagnet are not energized and the hydraulic flow path through the flow control valve 24 is closed. By opening and closing the flow from the hydraulic supply 44 to the second pump 34, the control valve 24 can adjust the velocity and output of the second pump 34.

In the present embodiment, a Pulse Width Modulation (PWM) signal is utilized to control the coil 21, which opens and closes the flow control valve 24 based on a duty cycle of the PWM signal. The PWM signal is generated based on the information from the PID controller 50. In this embodiment, the output of PID controller 50 is scaled to an integer corresponding to the operating range of the coil. The coil has an operating range of 0-1023, which is proportional to the amount of voltage being applied to the coil and represents a 0%-100% fluid flow opening through the flow control valve. The coil is commercially available from Hydraforce Inc. of 500 Barclay Blvd, Lincolnshire, IL as Part No. HFI PV70-30AG-8T-N12DL. Through experimentation, it has been determined that the actual operating range for the valve for 0%-100% is represented by a range between 200 and 750. That is, in the present embodiment, values within the range of 200 to 750 represent 0% to 100% opening through the valve; the response of the valve is linear over this range. Other coil/valve combinations may have other operating ranges.

This scaled integer value is utilized to produce a PWM signal having a corresponding duty cycle. For instance, if the output of the PID controller 50, scaled between 200 and 750 (i.e., a range of 450), was 425, a PWM signal having a 50% duty cycle may be generated. Accordingly, application of such a PWM signal to the coil 21 would result in the flow control valve being open one-half of the time and closed one-half of the time.

Figure 3:
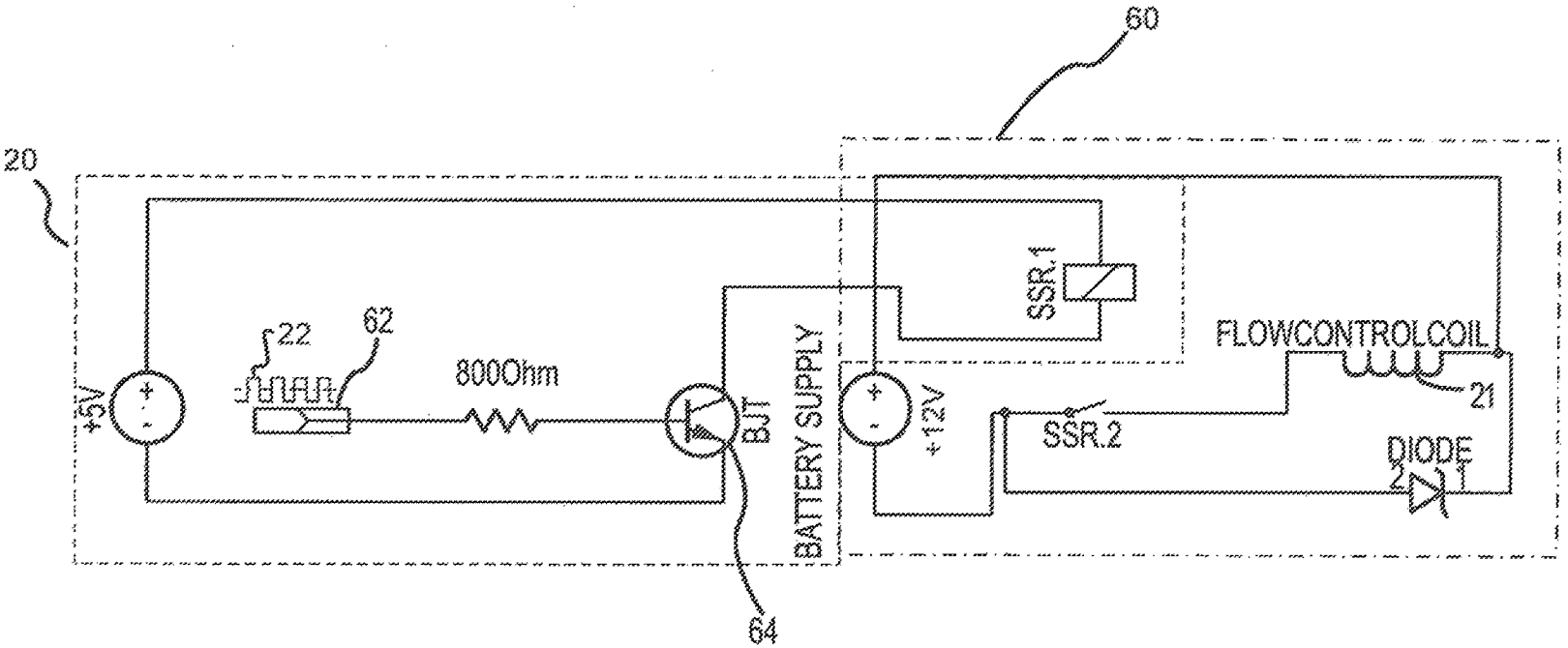
FIG. 3 illustrates a pulse-width modulation module.

FIG. 3, illustrates the PWM module 20, which applies the PWM signal 22 to a control circuit 60 of the coil 21. In this embodiment, the PLC controller 30 calculates a PWM duty cycle and generates a PWM signal 22, which is represented in the present embodiment as an exemplary square wave signal. However, this is not a requirement. In one embodiment, the PWM signal 22 may be generated at a frequency of about 100 hertz. Other frequencies are possible, but preferably the frequency is high enough such that the flow through the control valve 24 is substantially constant. The PWM signal 22 is received by an input 62 of the PWM module 20. The input may be a general purpose input output pin (GPIO) or any other connection that may be connected directly to the PLC controller 30 to receive the PWM signal 22. In this embodiment, the input 62 may be connected to the PWM module 20 through an electrical connection header that is connected to a base pin of a bipolar-junction transistor (BJT) 64 that controls the input of the PWM signal to a first solid state relay SSR.1. The first solid state relay SSR-1 opens and closes in accordance with the duty cycle of the PWM signal 22. The switching of the SSR.1 causes a second solid state relay (SSR.2) of the coil control circuit 60 to open and close in accordance with the duty cycle of SSR.1. This activates and deactivates coil 21 in accordance with the duty cycle of the PWM signal 22. As shown, the use of the coil control circuit 60 allows applying a voltage (e.g., 12v) to the coil 21, which may be larger than the voltage of the PWM module (e.g., 5v). In some aspects, SSR.2 may be protected by a throwback diode. In this embodiment, the PWM module 20 may be a part of the control circuit 12 and the connection between the PWM module 20 and the flow control valve may be hardwired.

Figure 4:
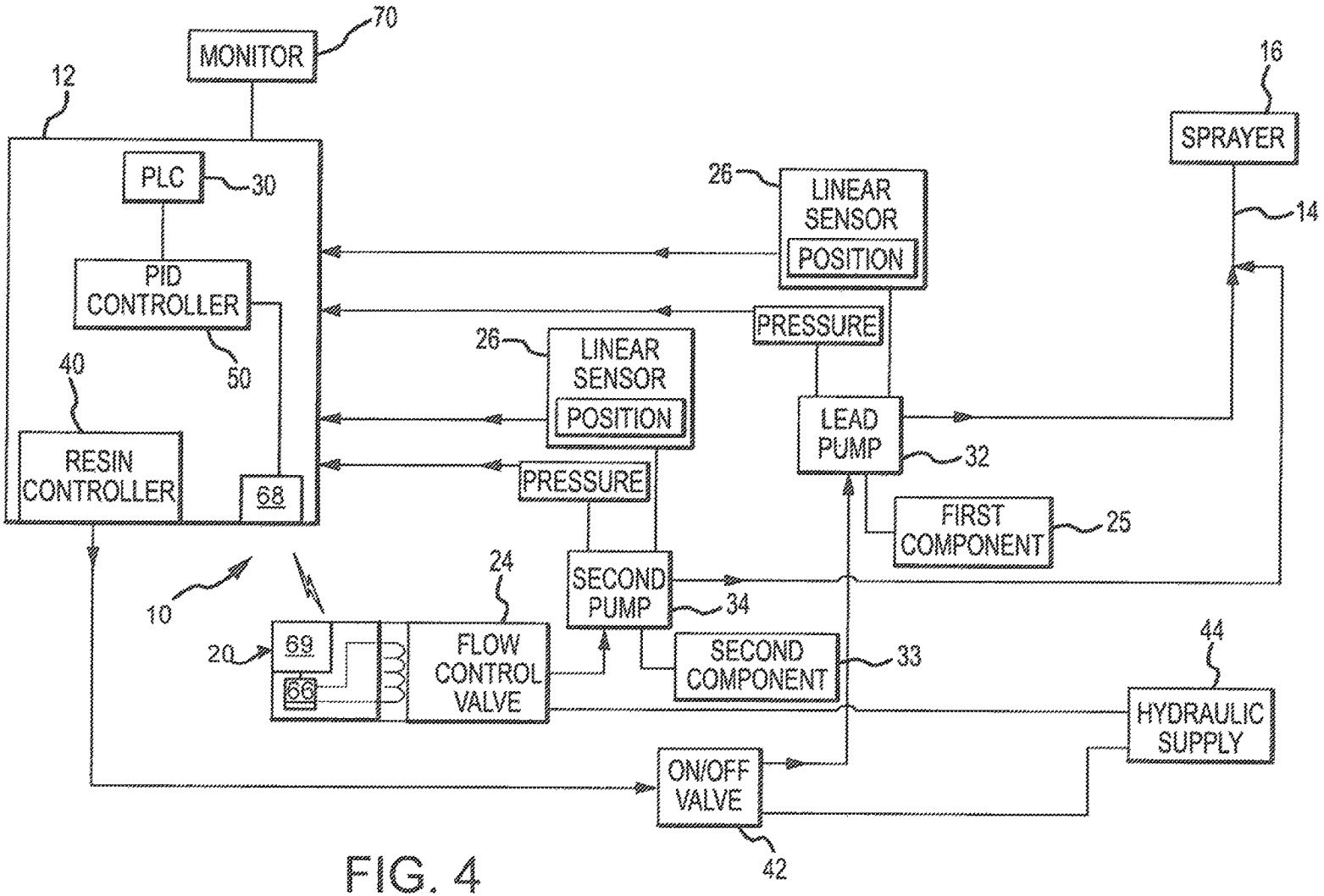
FIG. 4 illustrates a wireless multi-component mixture control system.

In another embodiment, illustrated in FIG. 4, the PLC of the control circuit 12 may be wirelessly connected to the PWM module 20, which may be co-located with the flow control valve 24. In this embodiment, the PWM module may further include a microcontroller 66 that is operative to generate the PWM signal based on inputs wirelessly received from the PLC controller 30. In this arrangement, the control circuit 12 and the PWM module 20 may each include a wireless transceiver 68, 69. In such an arrangement, the control circuit 12 and PWM module 20 may each contain, for example, an rs485 transceiver. Accordingly, once the PLC controller 30 receives an output from the PID controller 50, the PLC controller 30 may output the scaled integer value to its output port. This value is then wirelessly transmitted (e.g., in ASCII format) to the PWM module 20. At this time, the PWM module 20 may generate the PWM signal 22 for controlling the coil 21 and flow control valve 24. As will be appreciated, the wireless system illustrated in FIG. 4 may allow for readily retrofitting existing mixture control systems. However, such existing mixture control systems may be retrofitted with hard wired systems as well.

The electronic components of the MCM control system 10 may be controlled by a monitor 70, such as a LCD and touchpad, that is operatively associated with the control circuit 12 as well as physical switches that may be built into the control circuit 12 or PLC controller 30. An operator may set the mixing ratios on the LCD display with a keypad or other suitable means. The operator may also monitor the system pressures that are displayed on the monitor 70. If the pressure differences exceed a defined threshold both pumps may be shut down. In some aspects, one or more power switches (not shown) may be provided that controls the power supply to the electronic components of the MCM control system 10 including PLC controller 30, PWM module 20, PID controller 50, flow control valve 24, and sensors 26. A, switch (not shown) may also be provided to control the feedback loop allowing an operator to operate the lead pump 32 independently from the second pump 34 and to recalculate the mixing ratios by turning on the flow control valve 24 independently from the lead pump 32. A resin controller 40 may be connected to a solenoid or on/off valve 42 to control the first pump 32. Another switch may be used to recalculate the second component by turning on the flow control valve independently from the first pump.

Figure 5:
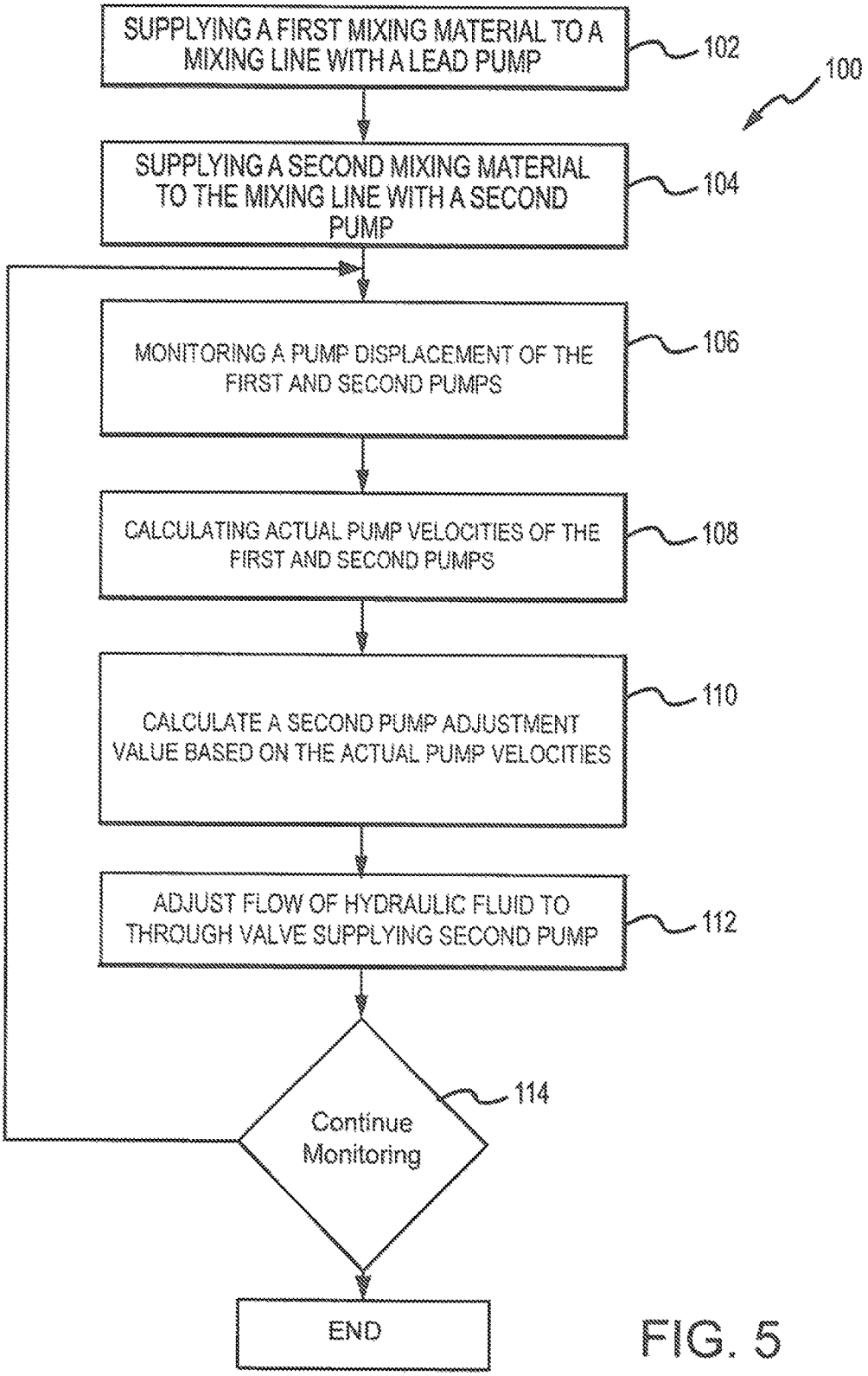
FIG. 5 illustrates one method for controlling the mixing ratio of a multi-component mixture.

As shown in FIG. 5, a method 100 for controlling the mixing ratio of a multi-component mixture may include supplying 102 a first mixing material to a mixing line with a first pump and supplying 104 a second mixing material to the mixing line with a second pump. The method may further include monitoring 106 a pump shaft displacements indicative of actual pump speeds/velocities of the first and second pumps. As noted above, these actual speeds may be utilized in conjunction with known pump displacements to determine the actual flows of the first mixing material and the second mixing material being supplied to the mixing line. The method includes sampling 108 a pump shaft displacement value for the first pump and the second pump and calculating an actual velocity of the first and second pumps. Based on the actual velocities of the pumps and a user set ratio for the first and second mixing material, a pump speed adjustment value is generated 110 in a feedback control loop. This pump speed adjustment value is utilized to adjust 112 a flow control valve that supplies hydraulic fluid to the second pump, thereby adjusting the velocity of the second pump. The method may further include repeating the above noted steps to provide 114 continual feedback based on the velocities of the first and second pumps.

Components of the MCM control system 10 may include a non-transitory computer-readable storage medium storing instructions, which, when executed by a computing device, causes the computing device to perform the methods described above. A computer readable medium may be any data storage device that is capable of storing data, or capable of permitting stored data to be read by a computer system. Examples include hard disk drives, flash memory cards, such as, secure digital memory cards, memory sticks, network attached storage, read-only memory, random-access memory, optical disks, holographic storage mediums, magnetic tapes, and other optical and non-optical data storage devices. In addition, various components of the disclosed embodiments may be implemented as electronic hardware, computer software, or combinations of both. The various illustrative components, methods, and steps described in connection with the embodiments disclosed may be implemented or performed with a general purpose processor, a digital signal processor, an application specific integrated circuit, a graphics processing unit, a field programmable gate array or other programmable logic device, discrete gate or transistor logic, discrete hardware components, or any combination designed to perform the functions described.

The foregoing description of the presented inventions has been presented for purposes of illustration and description. Furthermore, the description is not intended to limit the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A system for controlling the mixing ratio of a multi-component mixture, comprising:

a first hydraulic pump connectable to a hydraulic fluid source and being operative to pump a first component between a first component source and a mixing chamber;

a second hydraulic pump connectable to the hydraulic fluid source and being operative to pump a second component between a second component source and the mixing chamber;

a first sensor associated with a shaft of the first pump for generating a first output indicative of a velocity of the first pump;

a second sensor associated with a shaft of the second pump for generating a second output indicative of a velocity of the second pump;

a control circuit operative to:

calculate a first velocity of the first pump and a second velocity of the second pump by averaging a plurality of first pump velocities and a plurality of second pump velocities obtained over a predetermined time window, respectively, wherein said first pump velocities and said second pump velocities are determined from the first and second outputs of the first and second sensors; and generate a velocity adjustment signal for controlling the speed of the second pump; and a flow-control valve disposed between said second hydraulic pump and said hydraulic fluid source, wherein said valve receives said velocity adjustment signal and adjusts in response to said velocity adjustment signal to control a rate of flow of hydraulic fluid from said hydraulic fluid source to said second pump.

2. The system of claim 1, wherein at least one of said first and second sensors comprise:

a linear sensor operative to monitor a position of a target attached to the shaft of the pump and generate an output indicative of said position.

3. The system of claim 2, wherein the linear sensor comprises non-contact magnetic inductive linear sensor.

4. The system of claim 1, wherein said control circuit calculates said first pump velocities and said second pump velocities by subtracting an immediately previous sensor output from a current sensor output.

5. The system of claim 1, wherein the control circuit implements a feedback equation to generate said velocity adjustment signal.

6. The system of claim 5, wherein said feedback equation comprises a proportional-integral-derivative (PID) equation, wherein a set point of the equation is derived from the first velocity of the first pump and a feedback variable is associated with the second velocity of the second pump.

7. The system of claim 6, wherein said set point of the equation is the first velocity of the first pump scaled to a user set mixing ratio for the first and second components.

8. The system of claim 5, wherein an output of said feedback equation is utilized to set a duty cycle of a pulse width modulation (PWM) signal, wherein said PWM signal represents said velocity adjustment signal.

9. The system of claim 8, wherein said flow-control valve further comprises:

a coil operative to open and close a flow path through said flow-control valve in response to the duty cycle of the PWM signal, wherein the flow path connects said second pump and said hydraulic fluid source.

10. A system for controlling the mixing ratio of a multi-component mixture, comprising:

a first pump connectable to a hydraulic fluid source and being operative to pump a first component between a first component source and a mixing chamber;

a second pump connectable to the hydraulic fluid source and being operative to pump a second component between a second component source and the mixing chamber, wherein the first and second pumps are hydraulically actuated positive displacement pumps;

a first linear sensor associated with a reciprocating shaft of the first pump for generating a first output indicative of an absolute location of the reciprocating shaft of the first pump;

a second linear sensor associated with a reciprocating shaft of the second pump for generating a second output indicative of an absolute location of the reciprocating shaft of the second pump;

a control circuit operative to utilize the first and second outputs of the first and second linear sensors to generate a velocity adjustment signal for controlling the speed of the second pump; and a flow-control valve disposed between said second pump and said hydraulic fluid source, wherein said flow-control valve receives said velocity adjustment signal and adjusts in response to said velocity adjustment signal to control a rate of flow of hydraulic fluid from said hydraulic fluid source to said second pump.

11. The system of claim 10, wherein the first linear sensor is operative to monitor a position of a target attached to the reciprocating shaft of the first pump and generate an output indicative of said position of said target.

12. The system of claim 11, wherein the first linear sensor comprises a non-contact magnetic inductive linear sensor.

13. The system of claim 10, wherein the control circuit utilizes the first and second outputs of the first and second linear sensors to calculate a first velocity of the first pump and a second velocity of the second pump.

14. The system of claim 13, wherein said control circuit calculates said first and second velocities by subtracting an immediately previous sensor output from a current sensor output.

15. The system of claim 13, wherein said control circuit calculates said first and second velocities by averaging a plurality of first and second velocities, respectively, over a predetermined time window.

16. The system of claim 13, wherein the control circuit implements a feedback equation to generate said velocity adjustment signal.

17. The system of claim 16, wherein said feedback equation comprises a proportional-integral-derivative (PID) equation, wherein a set point of the equation is derived from the first velocity of the first pump and a feedback variable is associated with the second velocity of the second pump.

18. The system of claim 17, wherein said set point of the equation is the first velocity of the first pump scaled to a user set mixing ratio for the first and second components.

19. The system of claim 16, wherein an output of said feedback equation is utilized to set a duty cycle of a pulse width modulation (PWM) signal, wherein said PWM signal represents said velocity adjustment signal.

20. The system of claim 19, wherein said flow-control valve further comprises:

a coil operative to open and close a flow path through said flow-control valve in response to the duty cycle of the PWM signal, wherein the flow path connects said second pump and said hydraulic fluid source.

* * * * *